United States Patent [19]

Gimble

[11] Patent Number: 4,983,140

[45] Date of Patent: Jan. 8, 1991

[54] BACKLESS, STRAPLESS LADIES' BODY BRIEFER

[75] Inventor: Richard Gimble, New York, N.Y.

[73] Assignee: Va Bien Ltd., Inc., New York, N.Y.

[21] Appl. No.: 475,283

[22] Filed: Feb. 5, 1990

[51] Int. Cl.[5] ..... A41C 1/00; A41C 1/02

[52] U.S. Cl. ..... 450/27; 450/7; 450/22; 450/35; 450/41; 450/53; 450/143; 450/144; 2/67; 2/109

[58] Field of Search ..... 2/67, 109, 110; 450/22, 450/27, 53, 135, 139, 144, 143, 7, 11, 14, 16, 35, 41, 95

[56] References Cited

U.S. PATENT DOCUMENTS

| | | | |
|---|---|---|---|
| 198,597 | 12/1877 | Foy | 2/110 X |
| 607,639 | 7/1898 | Schneebeli | 2/109 |
| 802,763 | 10/1905 | Kops | 450/143 |
| 1;246,370 | 11/1917 | Wright et al. | 450/144 |
| 1,402,643 | 1/1922 | Newman | 450/143 |
| 1,698,070 | 1/1929 | Roth | 450/35 X |
| 1,762,399 | 6/1930 | Kops | 450/16 |
| 1,867,445 | 7/1932 | Dills | 2/67 |
| 2,031,022 | 2/1936 | Wipperman | 450/27 X |
| 2,075,387 | 3/1937 | Daniel | 2/67 |
| 2,090,076 | 8/1937 | Siegel | 450/14 X |
| 2,503,357 | 4/1950 | Shelton | 450/95 |
| 2,532,375 | 12/1950 | Sider | 2/67 X |
| 2,584,556 | 2/1952 | Cousins | 450/95 |
| 2,663,025 | 12/1953 | Isaac | 450/95 X |
| 2,671,218 | 3/1954 | Luhr | 450/22 |
| 2,822,547 | 2/1958 | Halstead | 450/22 |
| 2,926,668 | 3/1960 | Schaumer | 450/27 X |
| 3,301,259 | 1/1967 | McLeod | 450/53 X |
| 3,913,146 | 10/1975 | Zero | 2/109 X |
| 4,494,546 | 1/1985 | Steiman | 2/67 X |

*Primary Examiner*—Werner H. Schroeder
*Assistant Examiner*—Jeanette E. Chapman
*Attorney, Agent, or Firm*—Paul W. Garbo

[57] ABSTRACT

A backless, strapless ladies' body briefer is made practical by providing a lateral, full-length bone at each of the two seams connecting the front and back halves of the garment. The back half has a V-shaped cutout and an elastic band extending along the waistline and attached to the lateral bones. At least one auxiliary bone, spaced from each lateral bone, is attached to the elastic band and extends to the V-shaped cutout. Additional auxiliary bones attached to the elastic band can help keep the V-shaped edges of the garment snugly against the wearer's back.

8 Claims, 1 Drawing Sheet

BACKLESS, STRAPLESS LADIES' BODY BRIEFER

BACKGROUND OF THE INVENTION

This invention relates to an undergarment for women. More particularly, the invention provides a novel body briefer for ladies that is backless and strapless.

The feminine undergarment industry has designed various forms of undergarments in which, for example, bras are combined with girdles and girdles are combined with panties. The body briefer or all-in-one undergarment combines a bra, girdle and panty. Body briefers have heretofore been offered in strapless models which had high backs to keep the undergarments in place on feminine bodies. Other body briefers have been offered which were backless, i.e., a large V-shaped portion of a lady's back is left bare by the body briefer, but such body briefers required shoulder straps extending from the top portion of the bra to intermediate points in the two slanted edges that form the V-shaped back of the undergarment.

However, some evening gowns have been designed without shoulder straps and with deep-plunge bare backs. These gowns could be worn virtually only by women who did not require a bra and who carefully limited their movements. There has long been a need for a backless, strapless body briefer for women who require a bra as well as for women who may not need a bra but who will be able to move about with greater freedom and comfort when they wear backless, strapless gowns.

A principal object of this invention is to provide a backless, strapless body briefer.

Another important object is to provide a backless, strapless undergarment that is comfortable to wear and permits normal body movements.

Other features and advantages of the invention will be apparent from the description which follows.

SUMMARY OF THE INVENTION

In accordance with this invention, an improved backless, strapless body briefer has the usual front half comprising a bra with cups, preferably shaped by semi-circular underwire, a girdle portion made of an elasticized fabric such as DuPont's Lycra, and a panty portion, and an elasticized fabric back half comprising a stiffening bone extending along the full length of each of the two stitched edges joining the front and back halves of the undergarment, a substantially V-shaped cutout in the back half extending from the tops of the two full-length bones to a center at approximately the waistline, a wide elastic band at the waistline extending from one full-length bone to the other full-length bone and fastened to the cusp or bottom of the V-shaped cutout, and an auxiliary stiffening bone spaced from each full-length bone and extending from the edge of the V-shaped cutout down to and across the elastic band. Preferably, a second auxiliary stiffening bone extends from the V-shaped cutout down to and across the elastic band.

The principal elements of the improved feminine under-garment are the wide elastic band across the back half which is fastened to the two full-length bones and to the cusp of the V-shaped cutout, and the two, preferably four, auxiliary bones which are supported by the elastic band and extend up to the edges of the V-shaped cutout. In view of the important function of the elastic band in pulling together the back of the garment and giving support to the V-shaped cutout through the auxiliary bones so that it does not gape, i.e., does not hang loosely away from the body of the wearer, it is preferable to make the elastic band stronger and stiffer at its center where the cusp of the V-shaped cutout is sewn to the elastic band. Stiffening is easily accomplished by using two layers of elastic band stitched together. In most cases, the double-layer center of the elastic band will have a length in the range of about 2–4 inches. The elastic band which is a woven band of elastic threads and fiber threads usually has a width in the range of about 1.5 to 3 inches.

To further ensure that the edges of the V-shaped cutout cling neatly against the back of the garment wearer, a rubberized tape is sewn on the inside of the garment along the edges of the V-shaped cutout. The rubberized tape not only aids the clinging of the cutout but also provides stiffening or firmness to the edges of the cutout. Like the rubberized tape, the bones and elastic band are also fastened to the inside of the undergarment to give a smoother and neater exterior.

It is well to note that all of the materials used in producing the backless, strapless body briefer of this invention are materials that are widely used by the ladies' undergarment industry. These materials include not only the previously mentioned stretch fabric Lycra, bra underwire, bones, elastic band and rubberized tape but also laces for the bra cups, bindings and felt strips used to cover bones so that they do not have direct contact with the wearer's skin.

BRIEF DESCRIPTION OF THE DRAWINGS

To facilitate the further description and understanding of the invention, reference will be made to the accompanying drawings in which.

DESCRIPTION OF PREFERRED EMBODIMENT

Figure 1:
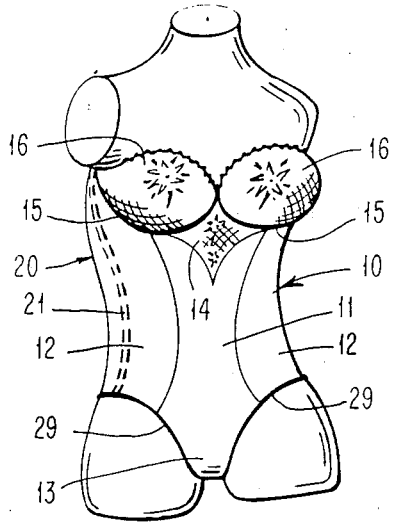
FIG. 1 is an essentially front view of a preferred embodiment of the novel undergarment on a display torso turned slightly to show the right hip side.

FIG. 1 shows the front half 10 of the new and improved feminine undergarment, which is made up of central fabric panel 11 sewn to two lateral fabric panels 12. Central panel 11 has narrow crotch portion 13 which connects with a similar crotch portion of the back half of the garment. As customary, hooks and eyes are used to provide the connection between crotch portion 13 and the crotch portion of the back half 20 of the garment. Preferably, central panel 11 is an elasticized fabric such as DuPont's Lycra and lateral panels 12 are elasticized netting. Both central panel 11 and lateral panels 12 need not be elastic materials. However, for snug fitting of the garment, it is advisable to use an elastic material at least for central panel 11 or lateral panels 12.

Central panel 11 has V-shaped insert 14 of lace sewn to its upper end. Semi-circular underwires 15 are in turn connected to the top of lace insert 14 as well as to the top of lateral panels 12. Bra cups 16 attached to underwires 15 may be formed of fabric, netting or lace which is the material shown in FIG. 1. While a preferred construction of front half 10 of the novel garment has been presented, it should be noted that many variations are known and may be substituted for the described front half 10 because the components of the undergarment which have made it possible to make a body briefer both backless and strapless are strategically positioned in the back half of the garment.

The longitudinal edges of front half 10 which are also the longitudinal edges of lateral panels 12 are sewn to the longitudinal edges of back half 20. A full-length bone 21 (only 1 is indicated in FIG. 1 by the stitching which holds it in place) is fastened at each of the two seams connecting front half 10 and back half 20. Full-length bones 21 have a length approximately equal to the distance from the armpit to the hip of the wearer.

Figure 2:
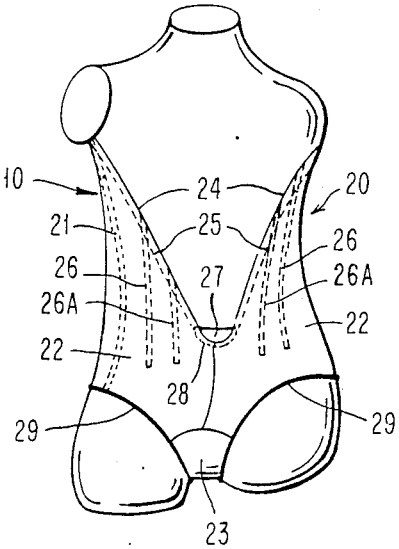
FIG. 2 is an essentially rear view of the undergarment displayed in FIG. 1 showing a small portion of the left hip side.

FIG. 2 shows that back half 20 is made of two pieces 22 of elasticized fabric sewn together along the centerline of back half 20. Back half 20 can be cut as a single piece but two pieces 22 are preferred to permit better shaping of the back of the garment. A tapered narrow piece 23 of fabric is stitched to the bottom of pieces 22 to provide the crotch band that can be connected to crotch portion 13 of front half 10.

The top of back half 20 has a V-shaped contour 24 so that a large portion of the wearer's back remains exposed. The stitching which holds one of the full-length bones 21 in place is visible in FIG. 2. Reference numeral 25 along contour 24 and reference numerals 26, 26A will be explained in the description of FIG. 3. Elastic band 27 only partially visible in FIG. 2 will also be fully described in connection with FIG. 3. However, it should be noted that stitching 28 fastens the edges of fabric pieces 22 at the cusp of V-shaped contour 24 to elastic band 27. The elastic band 27 is stitched to fabric pieces 22 only at the small rounded line of stitching 28 and transversely at each of bones 21, 26 and 26A. Elastic band 27 is not stitched to fabric pieces 22 along either its top or bottom edge. As usual, the bottom edges of the undergarment are covered with binding 29.

Figure 3:
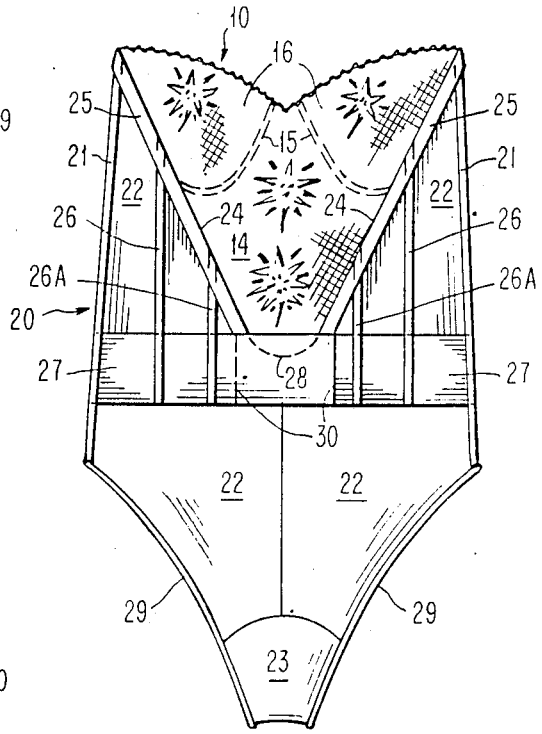
FIG. 3 is a view of the back half of the garment of FIG. 1 and FIG. 2 after it has been turned inside out and laid flat.

FIG. 3 shows the inside of back half 20 and the outside of only the top portion of front half 10 of the undergarment. Full-length ribs or bones 21 are sewn to the longitudinal edges of fabric pieces 22. It is well known in the undergarment industry that bones are attached to garments by laying the bone on the fabric of the garment, laying a tape or strip of the fabric, usually felt, over the bone, and sewing the edges of tape to the fabric so that the bone is captured between the fabric and tape. In view of this common practice, for simplicity, the positions in FIG. 3 of ribs or bones 21, 26, 26A are indicated by the overlay tape that is stitched to the garment.

The important structural elements which cooperate in making a practical undergarment that is both backless and strapless are clearly shown in FIG. 3. Elastic band 27 extends across back half 20 from one full-length bone 21 to the other and is connected by sewing to both bones 21. Elastic band 27 covers "the small of the back" which phrase is commonly defined as the narrow or slender part of the back. The overlay tapes of auxiliary ribs or bones 26, 26A are sewn through band 27 into fabric pieces 22 and all the way up to V-shaped contour 24. Each bone 26 attached to band 27 is spaced from a bone 21 by a distance equivalent to about 15 to 20% of the length of band 27. Each optional bone 26A is spaced from adjacent bone 26 at band 27 by a distance approximately equal to the distance between bones 21 and 26. While bones 21 slant toward each other, auxiliary bones 26, 26A are attached to band 27 at substantially right angles thereto and are attached to V-shaped contour 24 at spaced points thereon. Usually, if bones 26 are not exactly at right angles to band 27, they will preferably lean slightly away from each other and toward the adjacent bone 21. Stitching 28 fastens band 27 to the edges of fabric pieces 22 at the cusp of V-shaped contour 24.

The longitudinal center of band 27 is preferably strengthened and stiffened by using a double thickness thereof stitched together. FIG. 3 shows that band 27 is made of two pieces of elastic which overlap one another as indicated by lines 30. If band 27 is one piece from one bone 21 to the other, a short segment of elastic band can be sewn to that band 27 at the cusp of V-shaped contour 24. It is also advisable to sew a rubberized tape 25, referred to as gripper tape in the undergarment trade, along the V-shaped contour 24 to help keep the top edge of back half 20 against the wearer's back.

The success of the structural elements in providing a backless undergarment that is also strapless is believed to reside in the cooperating combination of full-length ribs 21 drawn firmly against the wearer's body by elastic band 27 which in turn provides firm support for auxiliary ribs 26, 26A that keep V-shaped contour 24 against the wearer's back.

As a specific example of the invention, a body briefer for size 34 (by standards set by the undergarment industry) has bones 21 measuring 13 inches each and extending from the top ends of V-shaped contour 24 to the panty portion, i.e., 2 inches below the bottom edge of elastic band 27. Optionally, bones 21 may end at the bottom edge of band 27 in which case each bone 21 will be 11 inches long. Elastic band 27 is 2¼ inches wide and 12 inches long measured along its centerline. At the cusp of V-shaped contour 24, band 27 has a double thickness that is 3 inches long. Each bone 26 is 8 inches long and is spaced 1½ inches from adjacent bone 21. Each bone 26A is 4 inches long and is spaced 1¼ inches from adjacent bone 26. Rubberized tape 25 is ½ inch wide and 8 inches long on each side of V-ahaped cutout 24. The dimensions of the fabric portions of the body briefer are in accordance with the size standards of the undergarment industry as are also the different cup sizes of the bra.

Those skilled in the art will readily visualize variations and modifications of the invention as illustrated and described herein without departing from the spirit or scope of the invention. For example, the straight sides of the V-shaped cutout may be gently curved inwardly or outwardly to approximate a U-shape. Similarly, the body briefer of the invention may be made of fabrics used in swimwear so that the garment is then a swimsuit. Therefore, the terms V-shaped and body briefer are intended to embrace such variations. Also, for instance, the stiffening of elastic band 27 by doubling its thickness at the cusp of V-shaped cutout 24 may alternatively be achieved by attaching a segment of stiffened fabric or even a short bone to band 27. Accordingly, only such limitations should be imposed on the invention as are set forth in the appended claims.

What is claimed is:

1. In a feminine body briefer that has a front half and a back half connected by two seams and that is strapless and backless with a substantially V-shaped contour forming a cusp in said back half of said body briefer, the improvement comprising a full-length bone sewn at each of said two seams where said back half is connected to said front half of said body briefer, an elastic band extending substantially along line of said back half of said body briefer, the ends of said elastic band being sewn to said two seams and the longitudinal middle of said elastic band being sewn to an edge of said back half at said cusp of said V-shaped contour, and at least one auxiliary bone spaced from each said full-length bone and extending from said V-shaped contour down to and transversing said elastic band, each said auxiliary bone being sewn to said elastic band and said back half.

2. The improvement of claim 1 wherein the elastic band has a double thickness in its longitudinal middle portion.

3. The improvement of claim 1 wherein a rubberized tape is sewn along the V-shaped contour on the inside of the back half of the body briefer.

4. The improvement of claim 3 wherein the elastic band has a double thickness in its longitudinal middle portion.

5. The improvement of claim 1 wherein two auxiliary bones are spaced from each full-length bone and from each other and extend across the elastic band substantially at right angles thereto.

6. The improvement of claim 5 wherein the elastic band has a double thickness in its longitudinal middle portion.

7. The improvement of claim 5 wherein a rubberized tape is sewn along the V-shaped contour on the inside of the back half of the body briefer.

8. The improvement of claim 7 wherein the elastic band has a double thickness in its longitudinal middle portion and has a width in the range of about 1.5 to 3 inches.

* * * * *

UNITED STATES PATENT AND TRADEMARK OFFICE

CERTIFICATE OF CORRECTION

PATENT NO. : 4,983,140

DATED : January 8, 1991

INVENTOR(S) : Richard Gimble

It is certified that error appears in the above-identified patent and that said Letters Patent is hereby corrected as shown below:

Column 5, line 2, "line" should be --a waistline--.

Signed and Sealed this

Eighteenth Day of August, 1992

*Attest:*

DOUGLAS B. COMER

*Attesting Officer*

*Acting Commissioner of Patents and Trademarks*